US009212539B2

(12) United States Patent
Traut

(10) Patent No.: US 9,212,539 B2
(45) Date of Patent: Dec. 15, 2015

(54) GRAVEL PACKER ASSEMBLY AND METHOD

(71) Applicant: David William Traut, Sartell, MN (US)

(72) Inventor: David William Traut, Sartell, MN (US)

( * ) Notice: Subject to any disclaimer, the term of this patent is extended or adjusted under 35 U.S.C. 154(b) by 416 days.

(21) Appl. No.: 13/764,325

(22) Filed: Feb. 11, 2013

(65) Prior Publication Data

US 2014/0224486 A1 Aug. 14, 2014

(51) Int. Cl.
*E21B 43/04* (2006.01)

(52) U.S. Cl.
CPC ..... *E21B 43/04* (2013.01); *E21B 43/045* (2013.01)

(58) Field of Classification Search
CPC ..... E21B 43/04; E21B 43/045
See application file for complete search history.

(56) References Cited

U.S. PATENT DOCUMENTS 4,508,174 A * 4/1985 Skinner et al. ..... 166/373
2003/0075324 A1* 4/2003 Dusterhoft et al. ..... 166/279
2007/0039741 A1* 2/2007 Hailey, Jr. ..... 166/376
2010/0122814 A1* 5/2010 Picou ..... 166/278
2012/0090687 A1* 4/2012 Grigsby et al. ..... 137/1

* cited by examiner

*Primary Examiner* — Giovanna C Wright
(74) *Attorney, Agent, or Firm* — Taft Stettinius & Hollister LLP

(57) ABSTRACT

A packer and screen assembly for a gravel or filter-packed well including a cylindrical shaped screen and a packer ring attached to an upper portion of the screen, with the packer ring positioned above an annular space surrounding the cylindrical-shaped screen and including an access opening having a closed configuration that substantially closes off the annular space and an open configuration that permits access to the annular space to fill the annular space with gravel or filter material. A method of filling or refilling a well with gravel or filter pack material is also provided including the steps of accessing the packer and screen assembly positioned within the well, transitioning the access opening in the packer ring from the closed configuration to the open configuration, and delivering gravel or filter pack material through the access opening and into the annular space surrounding the cylindrical-shaped screen.

28 Claims, 6 Drawing Sheets

GRAVEL PACKER ASSEMBLY AND METHOD

FIELD OF THE INVENTION

The present invention relates generally to gravel or filter-packed wells, and more particularly relates to devices and methods for adding/refilling gravel or filter pack material to a well borehole.

BACKGROUND

Gravel-packed wells are commonly used in the well drilling industry. FIG. 1 illustrates one example of a conventional gravel-packed well. In general, after a well borehole B is drilled to an appropriate depth along a centerline axis A, an outer cylindrical casing C is inserted into the borehole B to the full depth of the borehole. A cylindrical screen 10 attached to an inner cylindrical casing (not shown) is then lowered into the outer casing C and centered within the outer casing C via a number of centralizers or centering guides 12 positioned about the perimeter of the screen 10 to define an annular space S between the outer casing C and the screen 10. The annular space S between the outer casing C and the screen 10 is then filled with gravel pack material G and/or another type of filter pack material which fully surrounds the screen 10. During the filling process, the outer casing C may be gradually pulled back until the annular space S is filled to a desired pack depth above the top end of the screen 10.

Following initial placement of the gravel pack G, a development process may be initiated to clear the gravel pack G of fine sand or other unwanted materials and/or to clean up the contact surface between the gravel pack G and the surrounding native soils NS. Some development processes include passing compressed air through the gravel pack G, although other development procedures may also be used. During the development process, some settlement of the gravel pack G may occur, thereby requiring the addition of more gravel/filter media to maintain a pack depth above the top end of the screen 10. Once the gravel pack G is fully developed, the well bore space above the gravel pack G is sealed by a removable sealing apparatus or cap 14 that is lowered down through the outer casing C and into engagement with the upper end of the screen 10. The sealing apparatus illustrated in FIG. 1 includes a seal ring or packer 16, an upper neoprene or rubber seal 18*a* positioned between the inner diameter of the outer casing C and the outer diameter of an upper portion of the packer 16, and a lower neoprene or rubber seal 18*b* positioned between the inner diameter of a lower portion of the packer 16 and the outer diameter of an upper portion of the screen 10 (or the outer diameter of an annular flange or length of leader pipe attached to the upper portion of the screen 10).

In the illustrated embodiment, the packer 16 is provided with an upper cylindrical region 16*a* which supports the upper seal 18*a*, a lower cylindrical region 16*b* which abuts or supports the lower seal 18*b*, and a conical/tapered transition region 16*c* extending between the upper and lower cylindrical regions 16*a*, 16*b*. However, other types and configurations of packers may be used. The upper region 16*a* of the packer 16 may be removable attached to a support pipe or tether (not shown) to facilitate lowering of the packer 16 through the outer casing C and into position atop the upper portion of the screen 10. The upper region 16*a* may be removably attached to a support pipe via a bayonet-type attachment, a latch pin/hook arrangement, or other types of attachment mechanisms. The lower region 16*b* of the packer 16 may be removably attached to the upper end of the screen 10 (or to the annular flange or lead pipe if used) via a bayonet-type attachment, a hook/latch pin attachment, or other types of attachment mechanisms.

The devices and methods used in the conventional gravel-packed well illustrated in FIG. 1 suffer from various problems and drawbacks. For example, during initial construction of the well, it is difficult to maintain the gravel pack G in place, particularly while developing the gravel pack G via the use of compressed air (i.e., a portion of the gravel pack G may be blown out during the developing process). In order to address this concern, a lengthy leader pipe is sometimes added to the top end of the screen 10 to overcome buoyancy of gravel pack G caused by the addition of compressed air. However, the addition of a lengthy leader pipe adds to the overall cost of the well. Additionally, during the gravel pack filling process, it can be difficult to measure the level/depth of the gravel pack G, thereby risking underfilling or overfilling of the annular space S surrounding the screen 10.

Furthermore, over a period of time, most gravel-packed wells must be cleaned and redeveloped. During the aging period of a well, several feet of the gravel pack G may be lost to attrition. If the lost gravel pack G is not replaced, the native soils NS surrounding the annular space S or sands may envelope the portion of the screen 10 that is no longer surrounded by the gravel pack G and may intrude the well (i.e., contaminating the water supply provided by the well). In order to add additional gravel or filter material to the annular space S surrounding the screen 10 to replace the gravel pack lost to attrition, the packer 16 must be disengaged from the screen 10 and temporarily removed from the well via displacement up through the outer casing C. However, removal of the packer 16 can be difficult as the seals 18*a*, 18*b* may be torn off during removal and/or the packer 16 may become wedged/lodged within the outer casing C during removal due to the absence of the upper seal 18*a* and/or due to formation of a thick layer of rust along the inner surface of the outer casing C, thereby hindering or halting the removal process and the gravel refill process. As should be appreciated, if the packer 16 becomes lodged or stuck within the outer casing C, removal can be expensive and time consuming. Moreover, removal of the packer 16 from the screen 10 and/or displacement of the packer 16 through the outer casing C may be hindered or prevented if the screen 10 and the outer casing C are not centered/aligned in the well. Removal of the packer 16 from the screen 10 and/or displacement through the outer casing C can be quite difficult given that most wells are, at least to some extent, crooked or out of vertical alignment, the likes of which can be caused by initial misalignment of the components during installation or gradual shifting of the components over time. Also, removal of the packer 16 from the screen 10 can cause the screen 10 to shift and become misaligned/miscentered within the well during the refill process since the screen 10 will no longer be fully supported within the well, thereby complicating or preventing reattachment of the packer 16 to the screen 10 after refilling and redeveloping is complete. Additionally, the mechanisms used to attach the packer 16 to the screen 10 and/or to the support pipe/tether can tear away and/or corrode to such an extent as to make reattachment difficult if not impossible, thereby further hindering or preventing removal of the packer 16.

Thus, there remains a need to provide improved devices and methods for adding/refilling gravel or filter pack material to a well. The present invention satisfies this need and provides other benefits and advantages in a novel and unobvious manner.

SUMMARY

While the actual nature of the invention covered herein can only be determined with reference to the claims appended hereto, certain forms of the invention that are characteristic of the embodiments disclosed herein are described briefly as follows.

In one form of the invention, a packer and screen assembly is provided for a gravel or filter-packed well. The packer and screen assembly includes a cylindrical-shaped screen configured for positioning in a lower region of the well, and a packer ring attached to an upper portion of the screen and positioned above an annular space surrounding the cylindrical-shaped screen, the packer ring including an access opening having a closed configuration that substantially closes off the annular space surrounding the cylindrical-shaped screen and an open configuration that permits access to the annular space to fill the annular space with gravel or filter material.

In another form of the invention, a method is provided for filling or refilling a well with gravel or filter pack material. The method includes the steps of accessing a packer and screen assembly positioned within a lower region of the well, the assembly including a cylindrical-shaped screen and a packer ring attached to an upper portion of the screen and positioned above an annular space surrounding the cylindrical-shaped screen, the packer ring including an access opening having a closed configuration that substantially closes off the annular space and an open configuration that permits access to the annular space, transitioning the access opening in the packer ring from the closed configuration to the open configuration, and delivering gravel or filter pack material through the access opening in the packer ring and into the annular space surrounding the cylindrical-shaped screen.

It is one object of the present invention to provide improved devices and methods for adding/refilling gravel or filter pack material to a well. Further embodiments, forms, features, aspects, benefits, objects, and advantages of the present invention will become apparent from the detailed description and figures provided herewith.

DESCRIPTION OF THE ILLUSTRATED EMBODIMENTS

Figure 1:
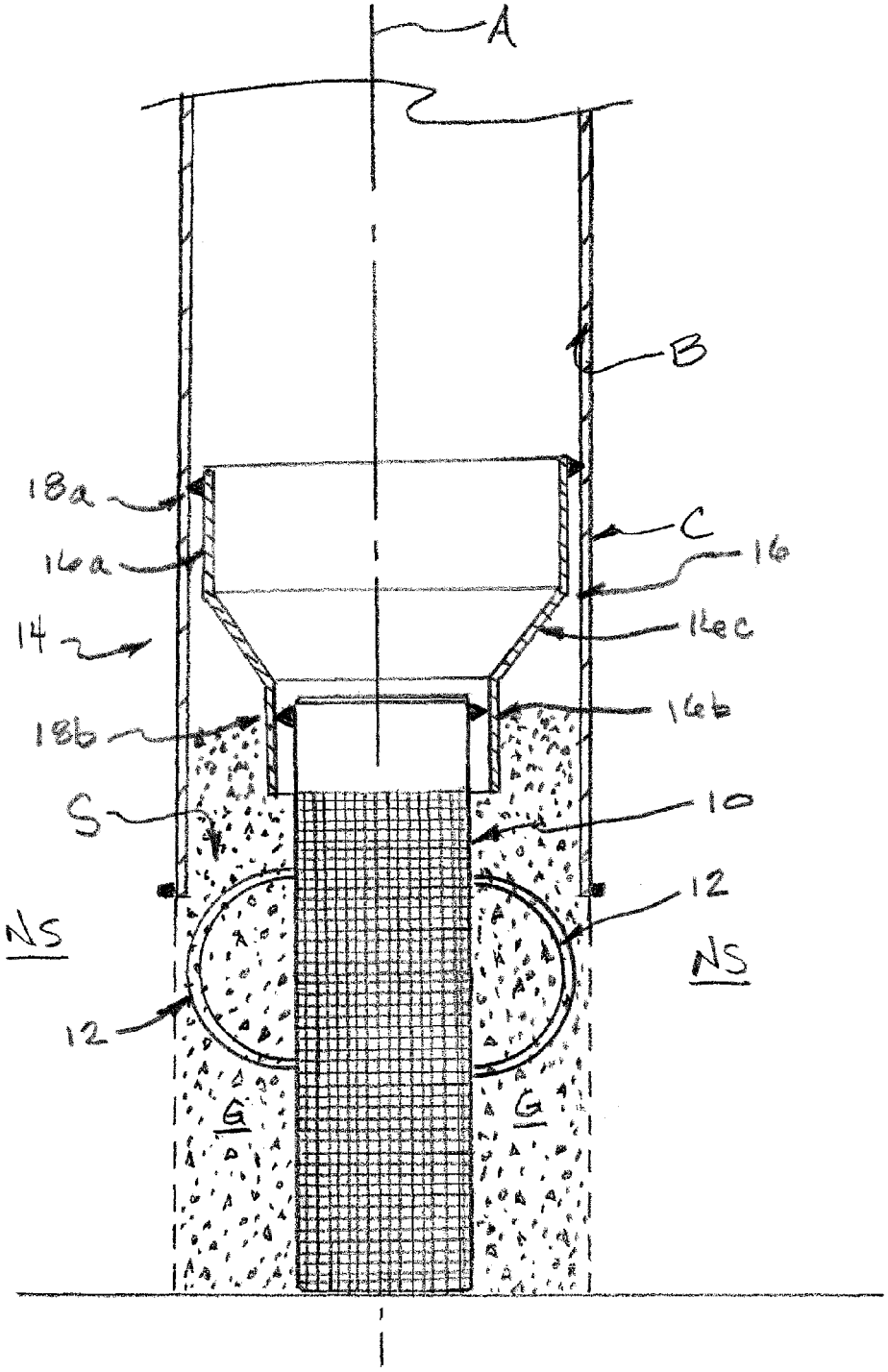
FIG. 1 (PRIOR ART)
FIG. 1 illustrates a partial cross-sectional side view of a conventional gravel-packed well including a conventional packer and screen assembly.

For the purpose of promoting an understanding of the principles of the present invention, reference will now be made to the embodiments illustrated in the drawings and specific language will be used to describe the same. It will nevertheless be understood that no limitation of the scope of the invention is hereby intended. Any alterations and further modifications in the described embodiments, and any further applications of the principles of the invention as described herein are contemplated as would normally occur to one skilled in the art to which the invention relates. The following descriptions and illustrations of non-limiting embodiments of the present invention are exemplary in nature, it being understood that the descriptions and illustrations related thereto are in no way intended to limit the inventions disclosed herein and/or their applications and uses.

Figure 2:
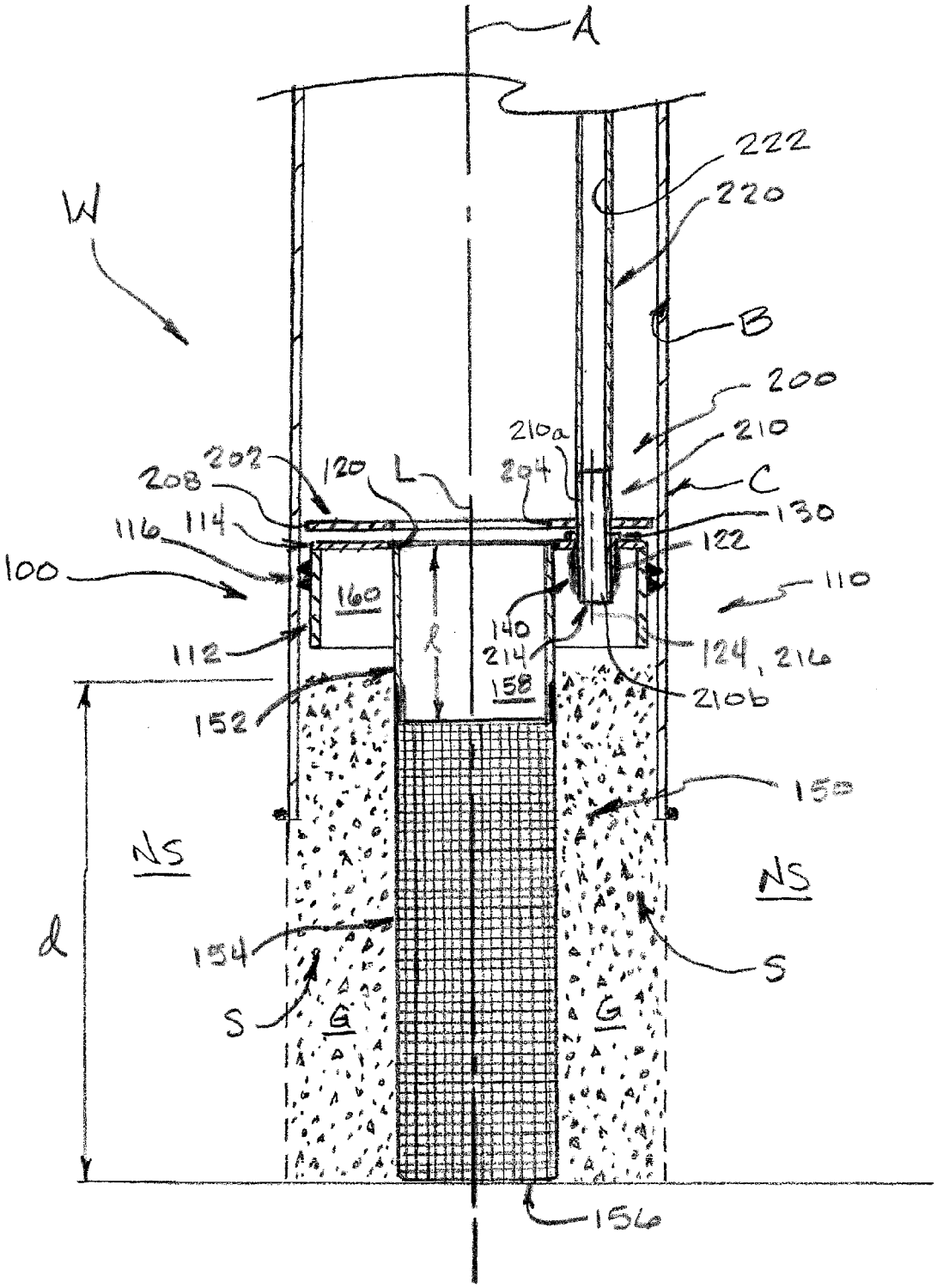
FIG. 2 illustrates a partial cross-sectional side view of a gravel-packed well including a packer and screen assembly and fill device according to one form of the present invention.

Referring to FIG. 2, illustrated therein is a gravel-packed or filter-packed well W including a packer and screen assembly 100 and a fill device 200 according to one form of the present invention. In the illustrated embodiment, the gravel packed well W generally includes an outer cylindrical casing C positioned within a well borehole B, each extending along a centerline axis A, and with the packer and screen assembly 100 positioned within the lower region of the gravel or filter-packed well W.

In the illustrated embodiment of the present invention, the packer and screen assembly 100 generally includes a packer ring 110 and a cylindrical screen 150 attached to and extending downwardly from the packer ring 110, each extending along a central longitudinal axis L. In one embodiment, an upper portion of the screen 150 is permanently attached to the packer ring 110 such as, for example, by welding. However, embodiments are also contemplated wherein the screen 150 may be removably attached to the packer ring 110 such as, for example, by fasteners, threading engagement, a bayonet-type attachment, a hook/latch pin attachment, or other types of attachment mechanisms. The packer ring 110 generally includes a cylindrical-shaped sidewall 112, a ring or disc-shaped top plate 114, and an annular seal 116 (commonly referred to as a "K" seal) extending about an outer periphery of the sidewall 112. The packer ring 110 is positionable within the outer casing C with the central longitudinal axis L generally co-axially aligned with the centerline axis A of the outer casing C and the borehole B, and with the annular seal 116 positioned in sealing engagement against the inner surface of the outer casing C. The annular seal 116 has an outer diameter sized in relatively close tolerance with the inner diameter of the outer casing C to provide for sealing engagement therebetween. Although the packer ring 110 and the screen 150 have been illustrated and described as having a particular shape/configuration, other shapes/configurations are also contemplated as falling within the scope of the present invention.

Referring collectively to FIGS. 2-5, shown therein are further details regarding the packer and screen assembly 100. As indicated above, the packer and screen assembly 100 generally includes a packer ring 110 and a cylindrical screen 150, with the packer ring 110 having a cylindrical-shaped sidewall 112, a ring or disc-shaped top plate 114, and an annular seal 116 extending about the sidewall 112. In the illustrated embodiment, the top plate 114 is formed separately from the sidewall 112 and is permanently attached thereto such as, for example, by welding or other suitable attachment techniques. However, other embodiments are also contemplated where the top plate is formed integral with the sidewall 112 to define a monolithic, single-piece structure. The sidewall 112 and top plate 114 may be formed of a metallic material or any other suitable material. The annular seal 116 may be attached to the exterior surface of the sidewall 112 by any suitable method including, for example, by fasteners or an adhesive. The annular seal 116 may be formed of neoprene, rubber or any other suitable sealing material.

In the illustrated embodiment, the top plate 114 defines a central through opening 120 extending from an upper plate surface 114*a* to a lower plate surface 114*b* and arranged generally along the central axis L. The top plate 114 further defines an access or fill opening/window 122 extending from the upper plate surface 114*a* to the lower plate surface 114*b* and arranged generally along an axis 124 radially offset from the central longitudinal axis L. In the illustrated embodiment, the axis 124 is arranged generally parallel with the central longitudinal axis L. However, other embodiments are also contemplated where the axis 124 is arranged oblique to the central longitudinal axis L. In the illustrated embodiment, the central opening 120 and the access opening 122 each have a generally circular shape. However, other shapes are also contemplated.

In the illustrated embodiment, the top plate 114 includes a stop or alignment element 130 projecting from the upper plate surface 114*a* and circumferentially offset from the access opening 122, the purpose of which will be discussed below. In the illustrated embodiment, the stop element 130 has a V-shaped configuration defining an inner contact region 132 facing the access opening 122. However, other shapes and configurations of the stop element 130 are also contemplated including, for example, a semi-circular configuration, a flat configuration, or other suitable shapes and configurations.

In the illustrated embodiment, the top plate 114 also includes an access door or gate element 140 (FIG. 5) movably attached to the lower plate surface 114*b* and configured to transition between a closed configuration that covers the access opening 122 to substantially close off the annular space S defined between the screen 150 and the casing C and/or the native soils NS, and an open configuration that permits access to the annular space S via the access opening 122, the details of which will be discussed below. In one embodiment, the access door 140 is configured as a plate having a generally flat or planar configuration. However, other shapes and configurations of the access door 140 are also contemplated.

Figure 8:
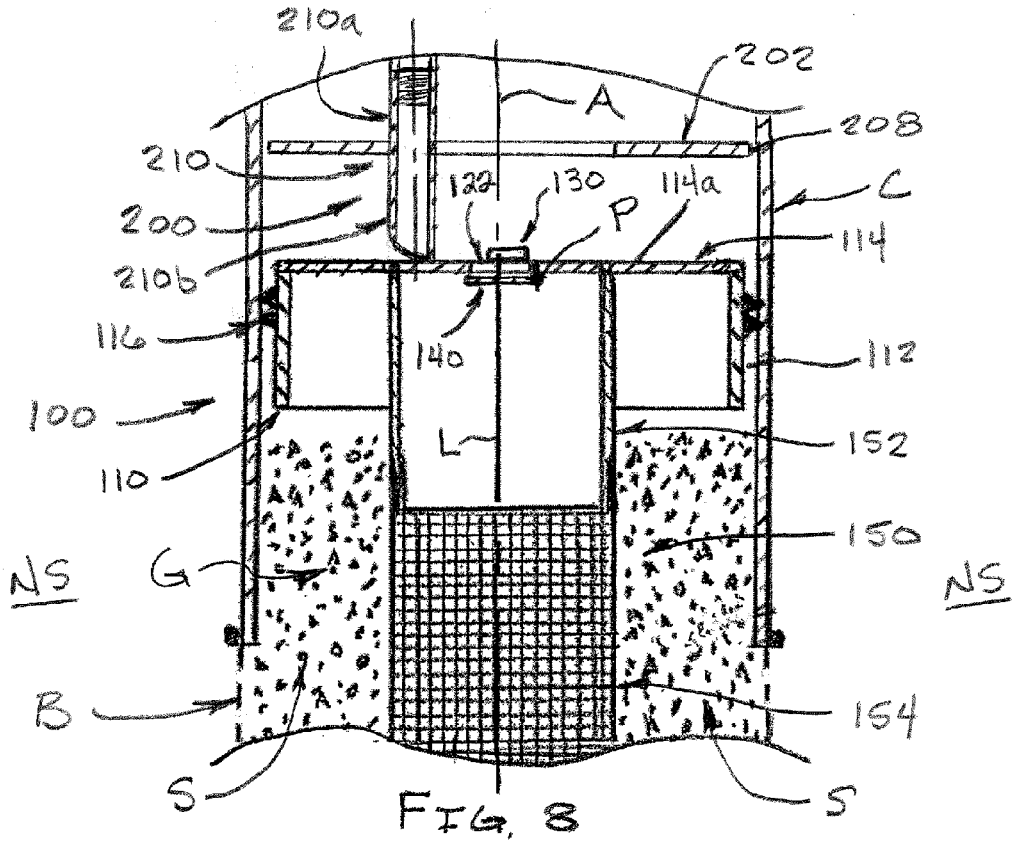
FIG. 8 illustrates a partial cross-sectional side view of the packer and screen assembly illustrated in FIG. 2 in a first operational configuration in relation to the fill device, with the access door shown in a closed position covering the access opening.
Figure 9:
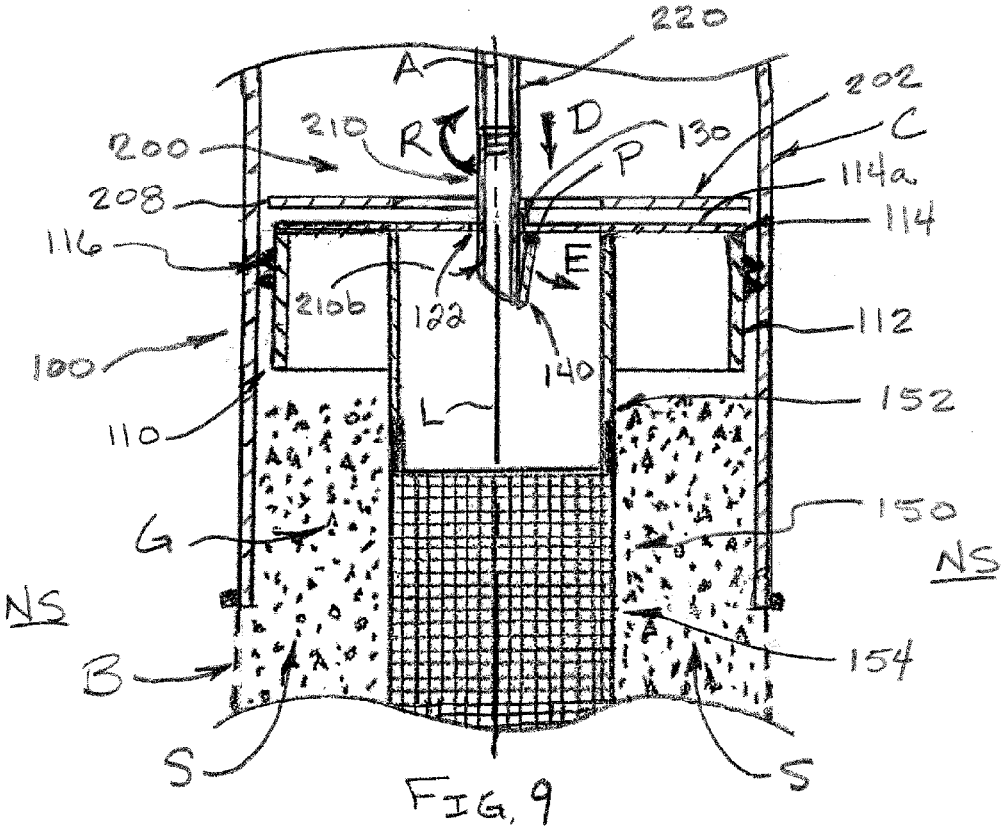
FIG. 9 illustrates a partial cross-sectional side view of the packer and screen assembly illustrated in FIG. 2 in a second operational configuration in relation to the fill device, with the access door shown in an open position and with the lower portion of the fill device extending through the access opening.

In the illustrated embodiment, the access door 140 is pivotally attached to the top plate 114 by a hinge-type connection device 142 to permit pivotal movement of the access door 140 about a pivot axis P between a closed configuration (FIG. 8) and an open configuration (FIG. 9). However, other devices and techniques for movably/pivotally attaching the access door 140 to the top plate 114 are also contemplated including, for example, a living hinge, a flexibly resilient connection, or other suitable types of attachment or connection devices or techniques. Additionally, in one embodiment, the connection device 142 is provided with a spring or biasing element 144 configured to spring load or bias the access door 140 toward the closed configuration to cover the access opening 122. In still other embodiments, rather than attachment of the access door 140 to the top plate 114, the access door 140 may alternatively be attached to the sidewall 112 of the packer ring 110 for transitioning between a closed configuration that covers the access opening 122 and an open configuration that permits access through the access opening 122.

Figure 3:
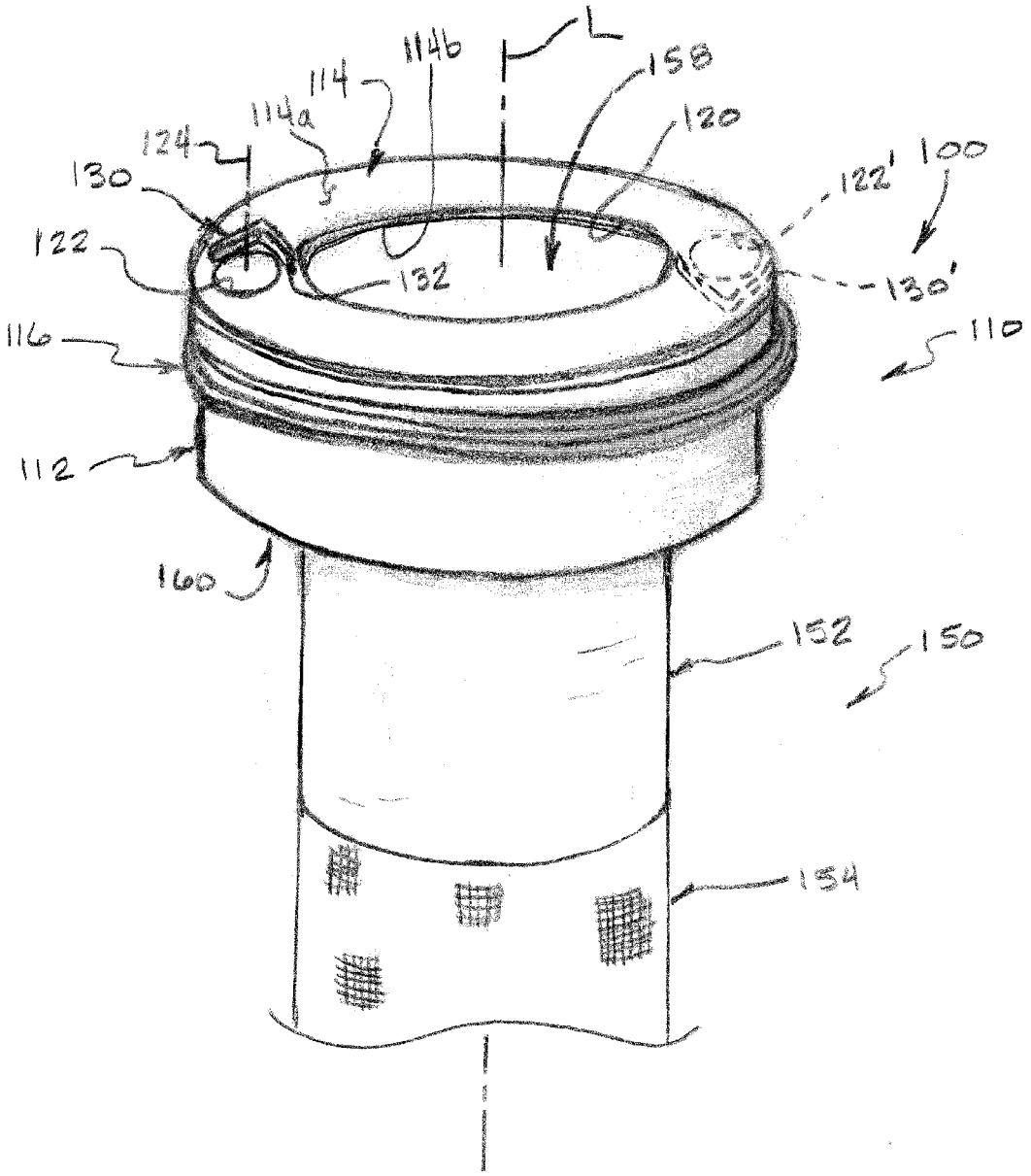
FIG. 3 illustrates a side perspective view of the packer and screen assembly illustrated in FIG. 2 according to one embodiment of the present invention.
Figure 4:
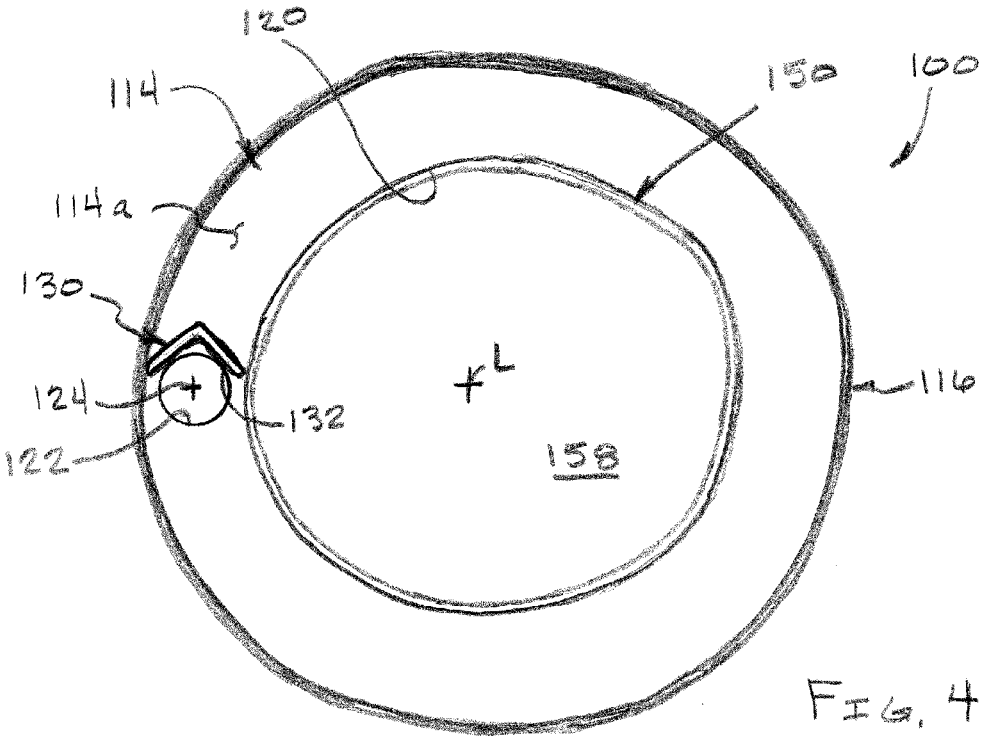
FIG. 4 illustrates a top view of the packer and screen assembly illustrated in FIG. 3.
Figure 5:
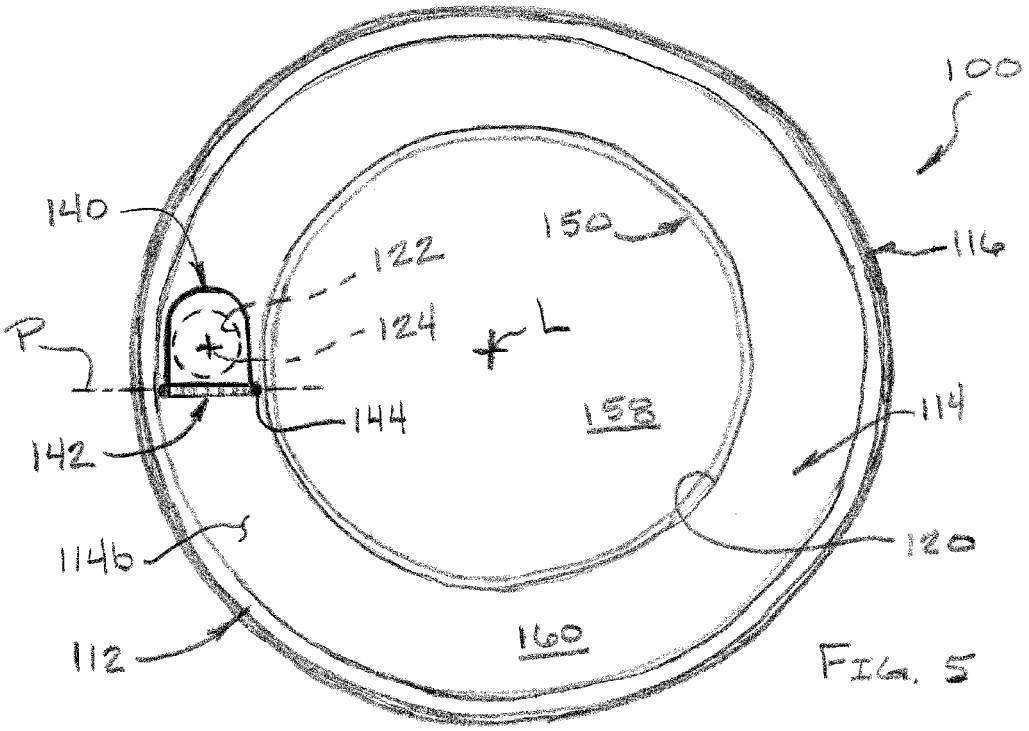
FIG. 5 illustrates a bottom view of the packer and screen assembly illustrated in FIG. 3.

In one embodiment of the invention, the top plate 114 is provided with a single access opening 122 along with a corresponding stop element 130 and access door 140. However, in other embodiments, the top plate 114 may be provided with two or more access openings 122, each including a corresponding stop element 130 and access door 140. For example, as illustrated in FIG. 3, in one such embodiment, the top plate 114 may be provided with the a second access opening 122' (shown in hidden lines) positioned diametrically opposite the first access opening 122 and including a corresponding stop element 130' adjacent the opening 122' and an access door (not shown) positioned beneath the second access opening 122'.

As indicated above, the cylindrical screen 150 may be permanently attached to the packer ring 110 such as, for example, by welding or any other suitable attachment technique. In the illustrated embodiment, the screen 150 includes a non-perforated leader pipe or cylindrical sleeve 152, a perforated cylindrical sidewall 154 and a bottom wall 156 (FIG. 2) that together define an interior region 158 of the screen 150. However, other suitable shapes and configurations of the screen 150 are also contemplated. In the illustrated embodiment, the screen leader pipe 152 is attached to the top plate 114 of the packer ring 110 adjacent the inner radial surface defining the central opening 120 such that the interior region 158 is in communication with the central opening 120, and to define an annular gap 160 between the cylindrical-shaped sidewall 112 of the packer ring 110 and the screen leader pipe 152. As should be appreciated, the length l of the screen leader pipe 152 may vary. As should also be appreciated, in other embodiments, the screen leader pipe 152 may be eliminated and the perforated screen sidewall 154 may be attached directly to the top plate 114 of the packer ring 110. As should be further appreciated, the perforated sidewall 154 of the screen 150 may be attached to the screen leader pipe 152 by various techniques including, for example, via welding, fastening, clamping, or any other suitable attachment technique. The perforated sidewall 154 is provided with an appropriate perforation/mesh size suitable to block particles (i.e., rocks, gravel, debris, etc.) of a certain size from entering the interior region 158 of the screen 150, the details of which would be apparent to one of ordinary skill in the art.

Figure 6:
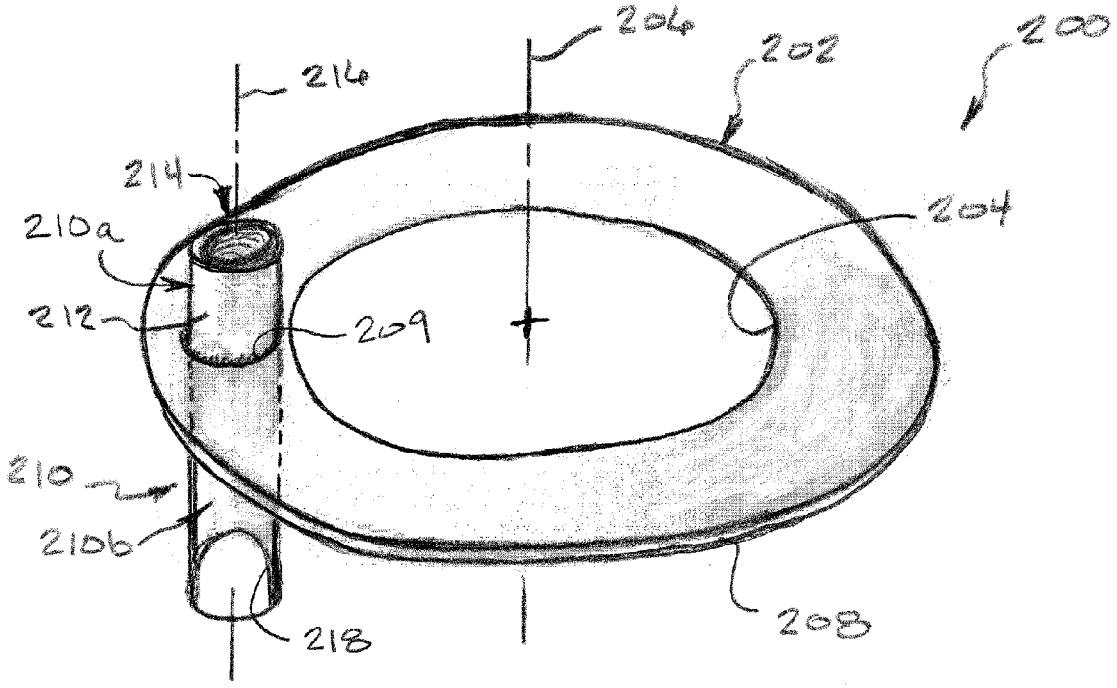
FIG. 6 illustrates perspective view of the fill device illustrated in FIG. 2 according to one embodiment of the present invention.
Figure 7:
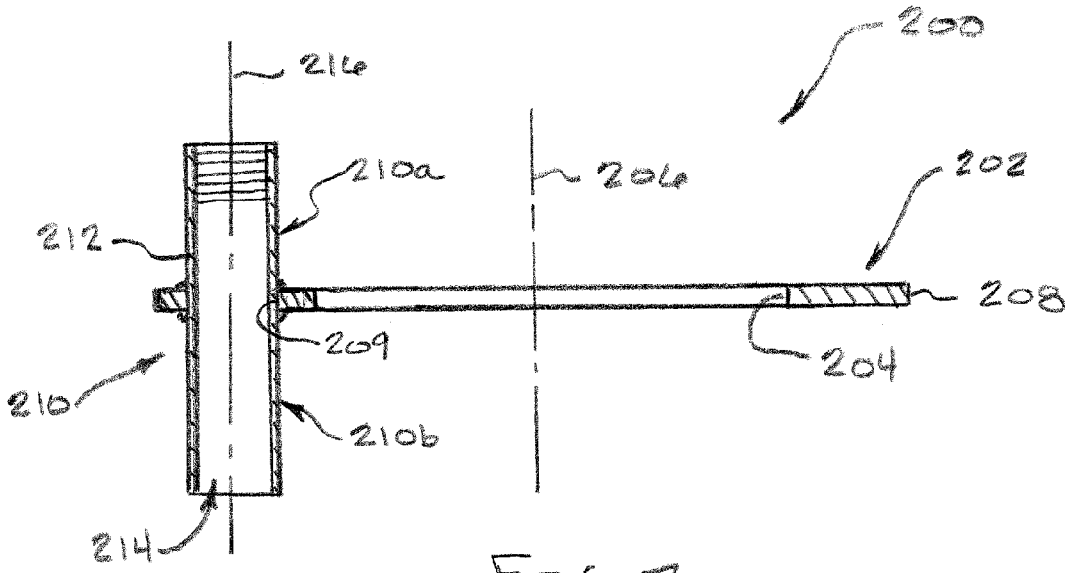
FIG. 7 illustrates a cross-sectional side view of the fill device illustrated in FIG. 6.

Referring collectively to FIGS. 2, 6 and 7 shown therein is a fill device 200 according to one form of the present invention for use in association with the packer and screen assembly 100. In the illustrated embodiment, the fill device 200 generally includes an alignment ring 202, a hollow sleeve or stem 210 attached to the alignment ring 202, and a fill pipe or tremie 220 (FIG. 2) connected to the sleeve 210. The alignment ring 202 defines a central opening 204 positioned along a central axis 206, the sleeve 210 includes a sidewall 212 defining a through passage 214 positioned generally along a passage axis 216, and the fill pipe or tremie 220 includes a hollow interior 222 positionable in fluid communication with the through passage 214 of the sleeve 210. Although the fill device 200 has been illustrated and described as having a particular shape/configuration, other shapes/configurations are also contemplated as falling within the scope of the present invention. Additionally, the components of the fill device 200 may be formed of a metallic material or any other suitable material.

In the illustrated embodiment, the central opening 204 of the alignment ring 202 has an inner diameter that generally corresponds to the inner diameter defined by the central opening 120 in the top plate 114 of the packer ring 110. The alignment ring 202 further has an outer diameter sized somewhat less than but in relatively close tolerance to the inner diameter of the outer casing C. In this manner, the alignment ring 202 is positionable within the outer casing C (FIGS. 2, 8 and 9), and engagement of the outer surface 208 of the ring 202 against the inner surface of the casing C will generally center the ring 202 within the casing C and generally align the central axis 206 of the ring 202 with the longitudinal central axis L of the packer and screen assembly 100. Additionally, when the alignment ring 202 is properly positioned and oriented/aligned within the casing C, the lower end of the sleeve 210 is positionable above and slidably engageable with the upper surface 114*a* of the top plate 114 of the packer ring 110, and the the sleeve 210 is alignable with the access opening 122 in the top plate 114, further details of which will be discussed below.

In the illustrated embodiment, the sleeve 210 has a generally cylindrical configuration and is sized to extend through an opening 209 in the alignment ring 202 with an upper portion 210*a* of the sleeve 210 positioned above the alignment ring 202 and a lower portion 210*b* of the sleeve 210 positioned below the alignment ring 202. The sleeve 210 may be attached to the alignment ring 202 by any suitable attachment technique such as, for example, welding. The upper portion 210*a* of the sleeve 210 is configured for connection to the fill pipe or tremie 220 with the hollow interior 222 of the fill pipe 220 positioned in fluid communication with the through passage 214 of the sleeve 210. In the illustrated embodiment, the upper portion 210*a* of the sleeve 210 is configured for threaded connection to an end of the fill pipe 220. However, other techniques for connecting the fill pipe 220 to the sleeve 210 are also contemplated including, for example, by welding or other suitable connection techniques. Although not specifically illustrated in the drawing figures, it should be understood that the fill pipe 220 may extend from the sleeve 210 to a location outside of the borehole B for receipt of a supply of the gravel or filter media G which is transported through the fill pipe 220 to the sleeve 210 and into the annular space defined between the screen 150 and the casing C and/or the native soils NS surrounding the screen 150. The lower end portion 210*b* of the sleeve 210 may define an angled or tapered end 218 to facilitate discharge of the gravel or filter material G from the sleeve 210.

Although the sleeve 210 and the fill pipe 220 have been illustrated as constituting separate components that are interconnectable with one another, in other embodiments, the sleeve 210 and the fill pipe 220 may be formed as a monolithic, single-piece component. It should also be understood that the fill pipe 220 may be formed of a series of pipe strings interconnected with one another to form a continuous file pipe 220 extending from the sleeve 210 to a location outside of the borehole B.

Referring collectively to FIGS. 2, 8 and 9, shown therein is the fill device 200 in relation to the packer and screen assembly 100. After the borehole B is drilled to the appropriate depth and the outer casing C is inserted into the borehole B, the packer and screen assembly 100 is lowered into the borehole B through the casing C until the bottom wall 156 of the screen 150 is positioned on or suspended just above the bottom of the borehole B. The central longitudinal axis L of the packer and screen assembly 100 is generally aligned with the centerline axis A of the borehole B, and with the annular seal 116 of the packer ring 110 positioned in sealing engagement against the inner surface of the outer casing C. Although not specifically illustrated in the drawing figures, the screen 150 may include a number of centralizers or centering guides to facilitate proper alignment and centering of the packer and screen assembly 100 within the borehole B and the outer casing C.

As illustrated in FIG. 8, once the packer and screen assembly 100 is properly positioned and aligned within the borehole B and the casing C with the top plate 114 of the packer ring 110 positioned above the annular space S surrounding the screen 150, the fill device 200 may be lowered down through the casing C until the lower end of the sleeve 210 rests in abutment against the upper surface 114*a* of the top plate 114 of the packer ring 110. As indicated above, engagement of the outer radial surface 208 of the alignment ring 202 against the inner surface of the casing C serves to generally center the fill device 200 within the casing C and align the central axis 206 of the alignment ring 202 with the longitudinal central axis L of the packer and screen assembly 100. Proper centering and alignment of the fill device 200 within the casing C in relation to the packer and screen assembly 100 ensures that the lower end of the sleeve 210 will be positioned in alignment with the top plate 114 of the packer ring 110.

With the lower end of the sleeve 210 resting in abutment against the upper surface 114*a* of the top plate 114, the fill device 200 may be rotated about the central axis 206 in the direction of rotation R until the lower end portion 210*b* of the sleeve 210 contacts the inner contact region 132 of the stop element 130. Abutting engagement of the lower end portion 210*b* of the sleeve 210 against the stop element 130 prevents further rotation of the fill device 200 and correspondingly aligns the lower end portion 210*b* of the sleeve 210 directly above the access opening 122 in the top plate 114, with the sleeve axis 216 generally aligned with the access opening axis 124. When the lower end portion 210*b* of the sleeve 210 is aligned directly above the access opening 122, the lower end portion 210*b* drops through the access opening 122 in the direction of arrow D and slidably engages the access door 140 and correspondingly pivots the access door 140 in the direction of arrow E from the closed configuration illustrated in FIG. 8 to the open configuration illustrated in FIG. 9.

When the fill device 200 is properly positioned relative to the packer and sleeve assembly 100 with the lower sleeve portion 210*b* extending through the access opening 122, gravel or filter material G may be fed through the fill pipe or tremie 220 and discharged from the sleeve 210 into the annular space S surrounding the screen 150. The gravel/filter material G is discharged into the annular space S until the annular space S is filled to an appropriate depth d (FIG. 2) with the gravel/filter material G completely surrounding the perforated sidewall 154 of the screen 150. The depth d of the gravel/filter material G preferably, but not necessarily, extends above the perforated sidewall 154 of the screen 150. During the filling process, the fill device 200 can be disengaged from the packer ring 110 by simply raising the fill device 200 to measure the depth d of the gravel/filter media G. If additional gravel/filter media G is required, the fill device 200 can be re-engaged with the packer and sleeve assembly 100 in the same manner described above to facilitate feeding of additional gravel/filter media into the annular space S.

Once the annular space S is filled to the appropriate depth d with the gravel/filter material G, the fill device 200 is disengaged from the packer ring 110 by simply raising the fill device 200, followed by removal of the fill device 200 from the borehole B. As should be appreciated, removal of the lower portion 210*b* of the sleeve 210 from the access opening 122 will cause the access door 140 to pivot back to the closed configuration illustrated in FIG. 8, once again covering the access opening 122. Either before or after removal of the fill device 200, the gravel/filter material within the annular space S can be developed to clear fine sand or other unwanted materials from the pack and/or to clean up the contact surface between the pack and the surrounding native soils NS. As indicated above, the development process may include passing compressed air through the gravel pack G, although other development procedures may also be used. Since the access opening 122 is closed off during development of the gravel pack G (either via positioning of the lower sleeve portion 210*b* within the access opening 122 or automatically closing the access door 140 to cover the access opening 122), the gravel/filter material will not be blown out of the annular space S during the developing process. Additionally, during the pack development process, some settlement of the gravel pack G may occur, thereby requiring the addition of more gravel/filter material to maintain an appropriate pack depth d. If required, the fill device 200 can be re-engaged with the packer and sleeve assembly 100 in the same manner described above to facilitate feeding of additional gravel/filter material into the annular space S.

As should be appreciated, upon disengagement of the fill device 200 from the packer and sleeve assembly 100 and removal of the fill device 200 from the borehole B, since the access door 140 is automatically pivoted back to the closed configuration illustrated in FIG. 8 to cover the access opening 122, there is no need to lower a separate sealing apparatus or cap down the borehole B to seal off the annular space S containing the gravel pack G, as is the case with prior devices and methods used in association with the conventional gravel-packed wells.

As indicated above, over time, most gravel-packed wells must be cleaned and re-developed. Moreover, during the aging period of a gravel-packed well, several feet of the gravel pack may be lost to attrition. With regard to prior devices and methods used in association with the conventional gravel-packed wells, adding additional gravel pack material requires disengagement of a sealing device (i.e., a conventional packer ring) from the upper portion of the screen, and displacement of the sealing device up through the casing C for complete removal from the well borehole B. As should be appreciated, removal of the sealing device can be difficult as the seals may be torn off during removal and/or the sealing device may become wedged/lodged within the casing C due to formation of a thick layer of rust along the inner surface of the casing C, thereby hindering or halting the gravel refill process and significantly increasing the time and expense associated with the refill process. Moreover, removal of the sealing device from the screen and/or displacement of the sealing device through the casing C may be hindered or prevented if the screen and/or the casing C are not appropriately centered within the well borehole. Additionally, removal of the sealing device from the screen and/or displacement through the casing C can be difficult and time consuming if the casing C and/or the borehole B are crooked or out of alignment. Furthermore, disengagement/removal of the sealing device from the screen can cause the screen to shift and become misaligned/mis-centered since the screen will no longer be fully supported within the well, thereby complicating or preventing reattachment of the sealing device to the screen after refilling and redeveloping is completed. Additionally, the mechanisms used to attach the sealing device to the screen can tear away and/or corrode to such an extent as to make reattachment difficult if not impossible, thereby further hindering or preventing removal of the sealing device from the screen and/or reattachment of the sealing device to the screen.

These and other risks, drawbacks, and disadvantages apparent with prior devices and methods used in association with conventional gravel-packed wells may be eliminated or minimized via use of the packer and screen assembly 100 and the fill device 200 of the present invention. For example, because disengagement and removal of the packer ring 110 from the screen 150 is not required to fill or refill the annular space S surrounding the screen 150 with gravel/filter pack material G, the risks and disadvantages outlined above are eliminated or significantly reduced. Additionally, because the annular space S surrounding the screen 150 is closed off from the area above the packer ring 110, the risk of blowing a portion of the gravel/filter pack out of the annular space S during the developing process is eliminated. Moreover, the length l of the leader pipe 152 positioned atop the perforated sidewall 154 of the screen 150 may be reduced or eliminated. Furthermore, reducing or eliminating the length l of the leader pipe 152 reduces the likelihood of bridging/binding of the gravel pack G, the likes of which may otherwise prevent the gravel pack G from settling into its proper position within the annular space S surrounding the screen 150. For these and other reasons, the packer and screen assembly 100 and fill device 200 of the present invention provide various benefits and advantages over prior devices and methods currently used in association with conventional gravel-packed wells.

Various changes and modifications to the described embodiments described herein will be apparent to those skilled in the art, and such changes and modifications can be made without departing from the spirit and scope of the invention and without diminishing its intended advantages. Additionally, while the invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

What is claimed is:

1. A packer and screen assembly for a gravel or filter-packed well, comprising:

a cylindrical-shaped screen configured for positioning in a lower region of the well;

a packer ring attached to an upper portion of said cylindrical-shaped screen and positioned above an annular space surrounding said cylindrical-shaped screen, said packer ring including an access opening having a closed configuration that substantially closes off said annular space and an open configuration that permits access to said annular space to fill said annular space with gravel or filter material; and a fill device configured to deliver gravel or filter material through said access opening in said packer ring and into said annular space surrounding said cylindrical-shaped screen, said fill device including a lower portion sized and configured to extend through said access opening in said packer ring.

2. The packer and screen assembly of claim 1, wherein said packer ring includes an access door having a first position that substantially covers said access opening to define said closed configuration, said access door having a second position that uncovers said access opening to define said open configuration.

3. The packer and screen assembly of claim 2, wherein said access door is pivotally engaged to said packer ring for pivotal movement between said open and closed positions.

4. The packer and screen assembly of claim 2, wherein said access door is biased toward said closed configuration.

5. The packer and screen assembly of claim 1, further comprising an access door pivotally attached to said packer ring, said access door having a closed position that substantially covers said access opening to define said closed configuration, said access door pivotal from said closed position to an position that uncovers said access opening to define said open configuration.

6. The packer and screen assembly of claim 5, wherein said access door is pivotally attached to said packer ring by a hinge element.

7. The packer and screen assembly of claim 6, wherein said access door is biased toward said closed configuration.

8. The packer and screen assembly of claim 7, wherein said access door is spring-loaded toward said closed configuration.

9. The packer and screen assembly of claim 1, wherein said packer ring defines two of said access openings positioned substantially diametrically opposite one another.

10. The packer and screen assembly of claim 1, wherein said packer ring includes a stop element adjacent said access opening, said stop element positioned for engagement with said lower portion of said fill device to align said lower portion with said access opening.

11. The packer and screen assembly of claim 10, wherein said lower portion of said fill device is abuttingly engaged against an upper surface of said packer ring; and wherein said fill device is rotated relative to said packer ring with said lower portion slidably engaged along said upper surface and into engagement with said stop element to thereby align said lower portion with said access opening.

12. The packer and screen assembly of claim 1, wherein said fill device includes an alignment ring having an outer diameter substantially corresponding to an inner diameter of a cylindrical well casing, said lower portion of said fill device extending from a lower surface of said alignment ring, said alignment ring engageable with an inner surface of said well casing to position said lower portion of said fill device into alignment with an upper surface of said packer ring defining said access opening.

13. The packer and screen assembly of claim 1, wherein said fill device includes a tremie line extending from a remote location outside of said well and communicating with said lower portion of said fill device to deliver said gravel or filter material from said remote location to said annular space surrounding said cylindrical-shaped screen.

14. The packer and screen assembly of claim 1, further comprising an annular seal extending about an outer periphery of said packer ring for sealing engagement with an outer cylindrical well casing.

15. The packer and screen assembly of claim 1, wherein said screen includes a non-perforated leader pipe length attached to said packer ring and a perforated sidewall extending from said non-perforated leader pipe length.

16. The packer and screen assembly of claim 1, wherein said cylindrical-shaped screen is permanently attached to said packer ring.

17. The packer and screen assembly of claim 16, wherein said cylindrical-shaped screen is welded to said packer ring.

18. A packer and screen assembly for a gravel or filter-packed well, comprising:

a cylindrical-shaped screen configured for positioning in a lower region of the well; and a packer ring attached to an upper portion of said cylindrical-shaped screen and positioned above an annular space surrounding said cylindrical-shaped screen, said packer ring including an access opening having a closed configuration that substantially closes off said annular space and an open configuration that permits access to said annular space to fill said annular space with gravel or filter material, wherein said packer ring includes:

a cylindrical-shaped sidewall;

a disc-shaped top plate attached to said cylindrical-shaped sidewall and defining said access opening, said upper portion of said screen attached to said top plate; and an annular seal extending circumferentially about said cylindrical-shaped sidewall for sealing engagement with an outer cylindrical well casing.

19. A method of filling/refilling a well with gravel or filter pack material, comprising:

accessing a packer and screen assembly positioned within a lower region of the well, the assembly including a cylindrical-shaped screen and a packer ring attached to an upper portion of the screen, the packer ring positioned above an annular space surrounding the cylindrical-shaped screen and including an access opening having a closed configuration that substantially closes off the annular space and an open configuration that permits access to the annular space;

transitioning the access opening in the packer ring from the closed configuration to the open configuration; and providing a fill device and delivering gravel or filter pack material through the access opening in the packer ring and into the annular space surrounding the cylindrical-shaped screen, the fill device including a lower portion sized and configured to extend through the access opening in the packer ring to facilitate the delivering.

20. The method of claim 19, wherein the packer ring includes an access door having a first position that substantially covers the access opening to define the closed configuration, the access door having a second position that uncovers the access opening to define the open configuration; and wherein the transitioning comprises moving the access door from the first position to the second position to provide access to the annular space surrounding the cylindrical-shaped screen.

21. The method of claim 20, wherein the transitioning comprises pivoting the access door from the first position to the second position to provide access to the annular space surrounding the cylindrical-shaped screen.

22. The method of claim 20, wherein the access door is biased toward the closed configuration, the method further comprising automatically transitioning the access door back to the closed configuration after the delivering.

23. The method of claim 19, further comprising:

engaging the lower portion of the fill device against an upper surface of the packer ring defining the access opening;

displacing the lower portion of the fill device along the upper surface of the packer ring and into alignment with the access opening; and inserting the lower portion of the fill device through the access opening in the packer ring to facilitate the delivering.

24. The method of claim 23, wherein the displacing comprises rotating the fill device relative to the packer ring until the lower portion of the fill device is positioned in alignment with the access opening.

25. The method of claim 23, further comprising displacing the lower portion of the fill device into engagement with a stop element positioned adjacent the access opening to align the lower portion of the fill device with the access opening prior to the inserting.

26. The method of claim 19, further comprising:

displacing the lower portion of the fill device into engagement with a stop element positioned adjacent the access opening to align the lower portion of the fill device with the access opening; and inserting the lower portion of the fill device through the access opening in the packer ring to facilitate the delivering.

27. The method of claim 19, further comprising:

rotating the fill device relative to the packer ring until the lower portion of the fill device is aligned with the access opening; and inserting the lower portion of the fill device through the access opening in the packer ring to facilitate the delivering.

28. The method of claim 27, wherein the fill device includes an alignment ring having an outer diameter substantially corresponding to an inner diameter of an outer cylindrical well casing; and engaging the alignment ring with an inner surface of the well casing to position and/or align the lower portion of the fill device relative to the packer ring.

* * * * *